US007313934B2

(12) United States Patent
Heo et al.

(10) Patent No.: US 7,313,934 B2
(45) Date of Patent: Jan. 1, 2008

(54) DETERGENT INJECTING DEVICE FOR WASHER

(75) Inventors: Seong Eun Heo, Gyeongsangnam-do (KR); Dong Yoon Kim, Gyeongsangnam-do (KR); Jong Ho Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 586 days.

(21) Appl. No.: 10/480,995

(22) PCT Filed: Apr. 17, 2003

(86) PCT No.: PCT/KR03/00778

§ 371 (c)(1),
(2), (4) Date: Dec. 17, 2003

(87) PCT Pub. No.: WO03/089708

PCT Pub. Date: Oct. 30, 2003

(65) Prior Publication Data

US 2004/0172770 A1 Sep. 9, 2004

(30) Foreign Application Priority Data

Apr. 17, 2002 (KR) ..... 10-2002-0021040
Apr. 17, 2002 (KR) ..... 10-2002-0021041
Aug. 30, 2002 (KR) ..... 10-2002-0051925
Aug. 30, 2003 (KR) ..... 10-2002-0051926

(51) Int. Cl.
*D06F 39/02* (2006.01)

(52) U.S. Cl. ..... 68/17 R; 39/2

(58) Field of Classification Search ..... 68/17 R, 68/207; 134/93; 137/268; 222/132; 39/2; *D06F 29/00*
See application file for complete search history.

(56) References Cited

U.S. PATENT DOCUMENTS 5,473,914 A 12/1995 Pyo et al.
6,227,012 B1 * 5/2001 Borroni et al. ..... 68/17 R
6,826,933 B2 * 12/2004 Merkle et al. ..... 68/17 R

FOREIGN PATENT DOCUMENTS

DE 198 59 984 A1 6/2000

(Continued)

OTHER PUBLICATIONS

Notification Of The First Office Action.

*Primary Examiner*—Michael Barr
*Assistant Examiner*—Jason P. Riggleman
(74) *Attorney, Agent, or Firm*—McKenna Long & Aldridge, LLP

(57) ABSTRACT

A laundry aid dispenser for a washing machine includes a top cover disposed above a washtub for receiving clothes, a receiving cavity defined by an upper wall, a bottom wall, opposing sidewalls, and an inner wall that are formed by indenting a portion of the top cover, a shower member comprising a shower portion coupled on the upper wall defining the receiving cavity and a warm water guide portion defined by a rear wall of the shower portion with the inner wall defining the receiving cavity, and a laundry aid container for storing laundry aids, the laundry aid container being inserted in the receiving cavity under the shower member. The laundry aid container has at least two chambers each for storing a different laundry aid.

36 Claims, 10 Drawing Sheets

FOREIGN PATENT DOCUMENTS

| | | | |
|---|---|---|---|
| EP | 0 927 784 A | | 7/1999 |
| JP | 5309194 | | 11/1993 |
| JP | 08238396 | * | 3/1995 |
| JP | 8-206390 | * | 8/1996 |
| JP | 08-206390 A | | 8/1996 |
| JP | 08-238396 | | 9/1996 |
| JP | 2000-233096 | * | 8/2000 |
| KR | 0131256 | | 9/1998 |

* cited by examiner

PRIOR ART

DETERGENT INJECTING DEVICE FOR WASHER

TECHNICAL FIELD

The present invention relates to a laundry aid dispenser for a washing machine, and more particularly to a dispenser for dispensing laundry aids such as detergent, softener, or bleach into a washtub of a washing machine.

BACKGROUND ART

A necessary amount of laundry aids such as detergent, softener, or bleach is properly dispensed to a washtub from a laundry aid container containing a predetermined amount of the laundry aid in accordance with laundering modes such as a rough washing mode, a main washing mode, a rinsing mode, and a spin mode.

FIG. 1 shows a washing machine employing a conventional laundry aid dispenser.

As shown in the drawing, a washing machine comprises an outer cabinet 2, a washtub 1 disposed in the outer cabinet 2, a top cover 3 secured to the upper end of the outer cabinet 2, an access lid 5 hingedly mounted for opening and closing an opening formed on the top cover 3 so that clothes can be loaded and unloaded through the opening, and an operation panel 4 for controlling the operation of the washing machine, provided in the rear area of the top cover 3.

In addition, in order to dispense the laundry aids into the washtub 1, there is provided a laundry aid dispenser comprising a housing 6 mounted on a rear-top area of the top cover 3 and extended toward the opening of the top cover 3, a laundry aid container 8 inserted into the housing 6, and a shower member 7 disposed on the laundry aid container 8. The laundry aid container 8 is divided into a plurality of chambers, each containing a different laundry aid. Water is supplied to a top of the housing 6 and is sprayed by the shower member 7 to a desired chamber of the container 8, the chamber containing a laundry aid for a current operation mode. The laundry aid contained in the desired chamber of the laundry aid container 8 is dissolved by the water from the shower member 7, and is then fed to the washtub 1.

However, the housing extending toward the opening of the top cover causes inconvenience to the user when loading and unloading clothes, and the complicated structure of the dispenser entails a problem of productivity. Furthermore, the water fed to the laundry aid container is likely to overflow to undesired spaces, which deteriorates washing efficiency.

In addition, the separately manufactured housing causes an increase in manufacturing costs.

DISCLOSURE OF THE INVENTION

Accordingly, the present invention is directed to a laundry aid dispenser that substantially obviates the problems caused by limitations and disadvantage of the conventional one.

One object of the present invention is to provide a laundry aid dispenser for a washing machine, which is designed in a simple structure so that a user can conveniently use it and a manufacturing process can be simplified.

Another object of the present invention is to provide a laundry aid dispenser for a washing machine, which is designed to prevent water fed to a laundry aid container from overflowing to undesired spaces, thereby improving washing efficiency.

To achieve the above objects, the present invention provides a laundry aid dispenser for a washing machine, comprising a top cover disposed above a washtub for receiving clothes; a receiving cavity defined by an upper wall, a bottom wall, opposing sidewalls, and an inner wall that are formed by indenting a portion of the top cover, the receiving cavity having a plurality of cold and warm water supply nozzles; a shower member comprising a shower portion coupled on the upper wall defining the receiving cavity and a warm water guide portion defined by a rear wall of the shower portion with the inner wall defining the receiving cavity; and a laundry aid container for storing laundry aids, the laundry aid container being inserted in the receiving cavity under the shower member, the laundry aid container having at least two chambers for storing different laundry aids.

According to another aspect, the present invention provides a method for mounting a laundry aid dispenser on a washing machine, comprising the steps of inserting a shower member in a receiving cavity defined by indenting a portion of a top cover of the washing machine; securely fixing the shower member by a screw coupling; and inserting a laundry aid container in the receiving cavity.

BRIEF DESCRIPTION OF THE DRAWINGS

The above objects, other features and advantages of the present invention will become more apparent by describing the preferred embodiments thereof with reference to the accompanying drawings, in which.

BEST MODE FOR CARRYING OUT THE INVENTION

Hereinafter, preferred embodiments of the present invention will be described in detail with reference to the attached drawings.

Figure 1:
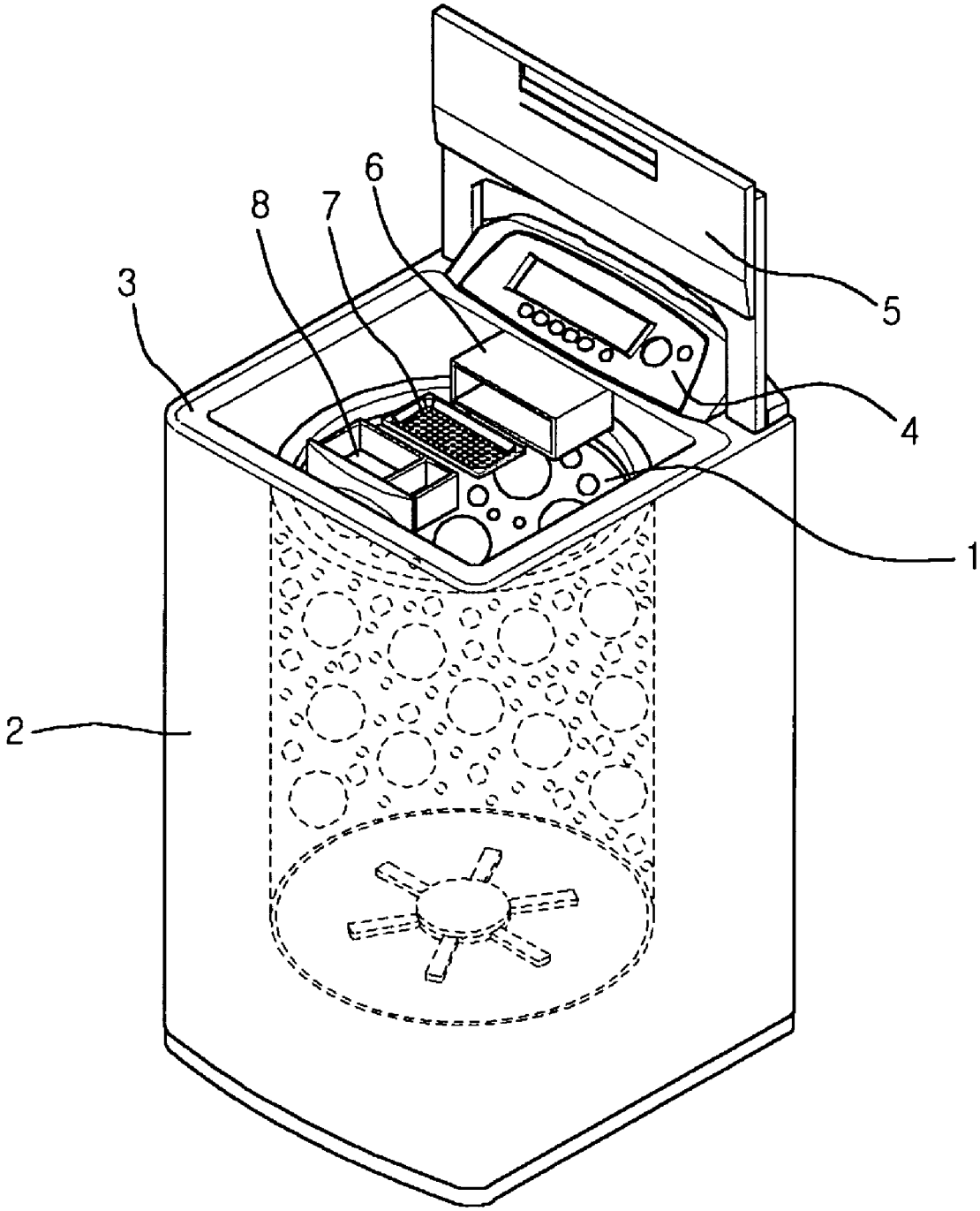
FIG. 1 is a perspective view of a washing machine employing a conventional laundry aid dispenser.
Figure 2:
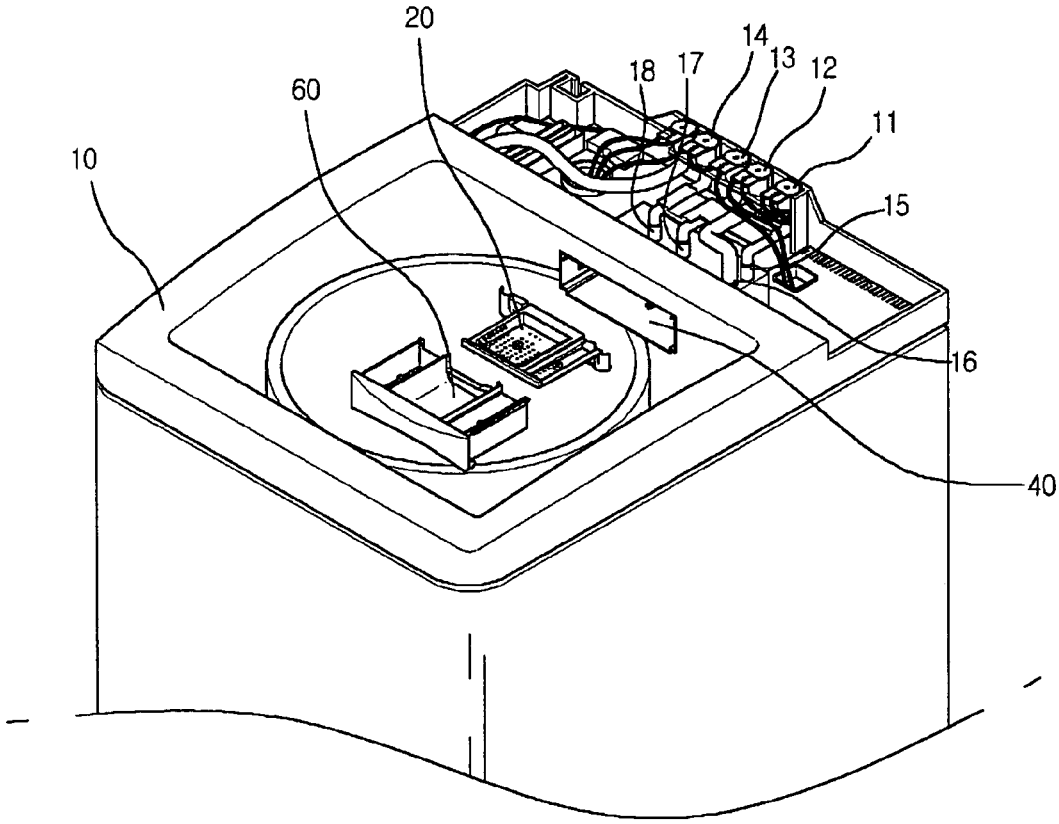
FIG. 2 is a perspective view of a washing machine. employing a laundry aid dispenser according to a preferred embodiment of the present invention.

FIG. 2 shows a washing machine employing a laundry aid dispenser according to a preferred embodiment of the present invention.

As shown in the drawing, the inventive laundry aid dispenser comprises a top cover 10 having an opening, a receiving cavity 40 formed on an inner-rear wall defining an opening of the top cover 10, a laundry aid container 60 received in the receiving cavity 40, and a shower member 20 disposed on top of the laundry aid container 60 and received in the receiving cavity 40.

A warm water supply tube 11, and first, second, and third cold water supply tubes 12, 13, and 14 are provided on a rear area of the top cover 10.

Downstream ends of the water supply tubes 11, 12, 13, and 14 are connected to the top cover 10 by first, second, third, and fourth nozzles 15, 16, 17, and 18.

Water is first supplied to the water supply tubes 11, 12, 13, and 14, and is then directed in the receiving cavity 40 through the nozzles 15, 16, 17, and 18. The water is then fed to the top of the shower member 20. The water fed to the shower member 20 is supplied to a plurality of chambers defined in the laundry aid container 60 while flowing along a plurality of branches through a plurality of through holes.

Laundry aids contained in the chambers of the laundry aid container 60 are mixed with the water and then fed to a washtub.

Describing an insertion process of the laundry aid container 60 and the shower member 20 in the receiving cavity 40, the shower member 20 is first inserted into the receiving cavity 40 along a guide portion formed on a wall defining the receiving cavity 40, and is then securely fixed by a screw-coupling process. Then, the laundry aid container 60 is inserted into the receiving cavity 40 along a support/guide portion formed on the wall defining the receiving cavity 40.

Although the receiving cavity 40 is formed on an inner-rear wall of the top cover 10, the present invention is not limited to this. That is, the receiving cavity 40 may be formed on inner-side walls of the top cover 10.

Figure 3:
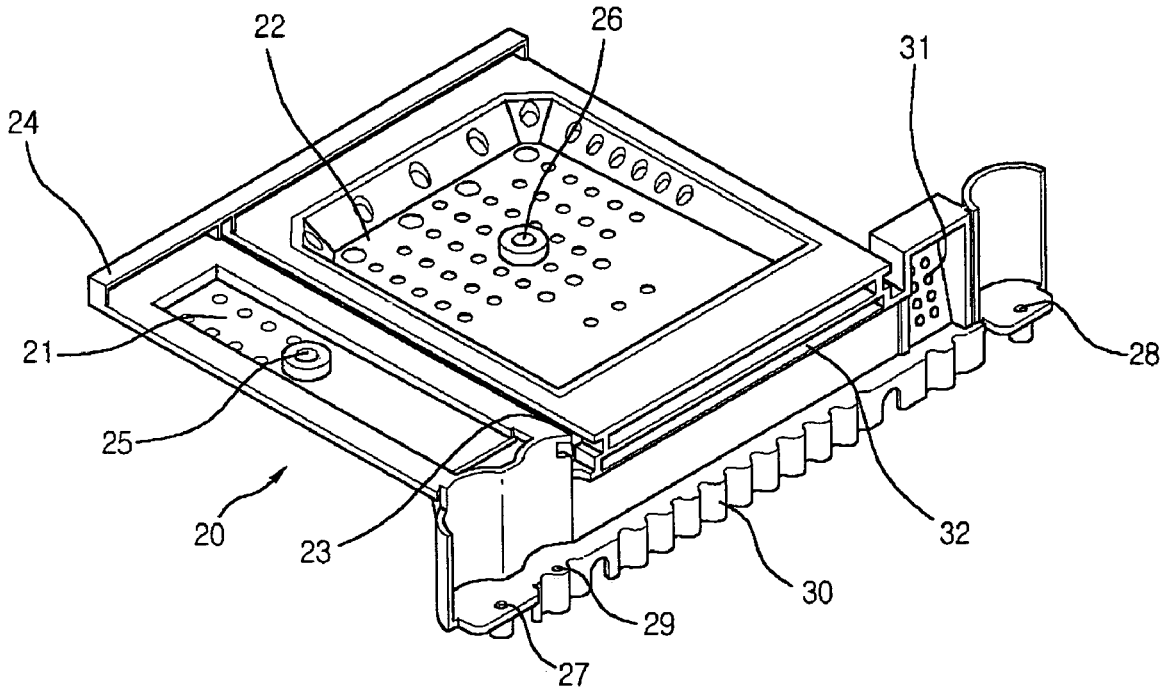
FIG. 3 is a rear perspective view of a shower member of a laundry aid dispenser according to a preferred embodiment of the present invention.

FIG. 3 shows a detailed rear perspective view of the shower member.

As shown in the drawing, the shower member 20 comprises an addition agent shower portion 21 that is indented and inclined frontward; a detergent shower portion 22 that is indented and inclined frontward; a rib guide 23 for guiding the insertion of the shower member 20 into the receiving cavity 40, the rib guide 23 being formed in a longitudinal groove shape between the addition agent shower portion 21 and the detergent shower portion 22; a hook 24 formed on a front-end top of the shower member 20; and bottom fixing holes 25 and 26 respectively formed on bottoms of the shower portions 21 and 22 for securely fixing the shower member 20 on the wall defining the receiving cavity 40 with screws.

The shower member 20 further comprises a warm water guide portion formed extending downward from rear end portions of the shower portions 21 and 22, and an inner-rear wall defining the receiving cavity 40. The warm water guide portion defines a warm water staying space together with an inner-rear wall defining the receiving cavity 40.

That is, the warm water guide portion comprises rear fixing holes 27 and 28 through which screws penetrating the top cover 10 are screwed; a warm water drain hole 29 for draining warm water fed from the nozzle 15 shown in FIG. 2 to the washtub via the receiving cavity 40; a wave wall 30 for feeding the warm water when the warm water cannot be completely drained through the warm water drain hole 29; a auxiliary warm water drain portion 31 formed and vertically inclined on one side of the wave wall 30, the auxiliary warm water drain portion 31 having a plurality of holes; and a check groove 32 horizontally formed above the wave wall 30.

The addition agent shower portion 21 and the detergent shower portion 22 have a plurality of holes formed at their bottoms and sidewalls so that water can be quickly sprayed in multiple ways through the holes.

The rib guide 23 guides the insertion location of the shower member 20 in the receiving cavity 40.

The hook 24 is fitted in a predetermined hook structure formed on an upper wall defining the receiving cavity 40 to securely fix the shower member 20. In addition, the hook groove 23 also functions as a barrier for preventing water from overflowing frontward. That is, even when the water overflows the shower portions 21 and 22, it flows only rearward, thereby being drained into the washtub via the receiving cavity 40.

The bottom fixing holes 25 and 26 are aligned with insertion holes (not shown) formed on the top cover 10 so that screws can be screwed into the aligned holes, thereby securely fixing the shower member 20 on the top cover 10.

The rear fixing holes 27 and 28 further enhance the fixture of the shower member 20 on the cover 10.

The warm water drain hole 29 is aligned with the warm nozzle 15 shown in FIG. 2, so that the warm water can be firstly fed into the washtub.

The wave wall 30 defines a plurality of holes with the inner-rear wall defining the receiving cavity 40, to allow the warm water that cannot be drained through the warm water drain hole 29 to flow into the washtub.

The auxiliary warm water drain portion 31 is provided to allow the warm water that is not drained even through the wave wall 30 to be drained. The auxiliary warm water drain portion 31 is vertically inclined frontward so that the warm water can be more quickly drained. A frontward portion of the auxiliary warm water drain portion 31 contacts a rear wall of the laundry aid container while defining a space between them, through which the warm water is drained to the receiving cavity 40.

The check groove 32 prevents the warm water that is not drained even through the auxiliary warm water drain portion 31 from overflowing into the shower portions 21 and 22.

Figure 4:
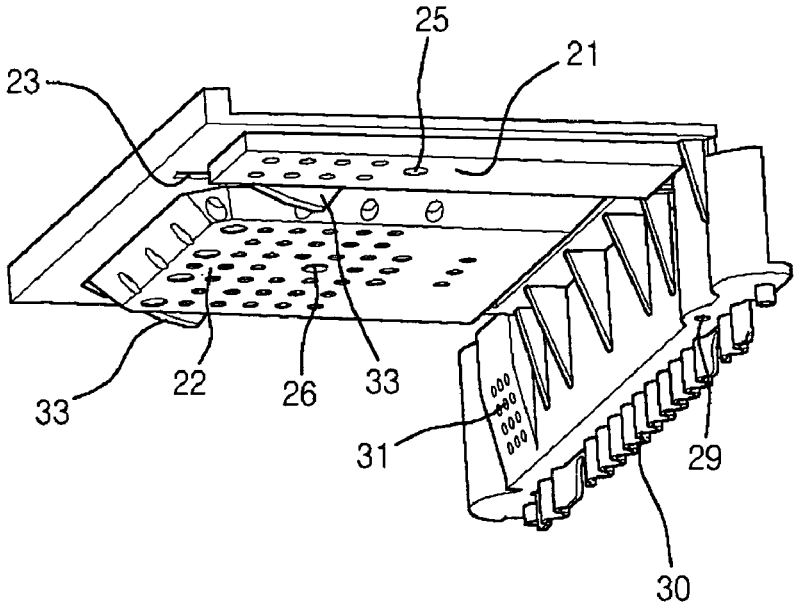
FIG. 4 is a bottom perspective view of a shower member of a laundry aid dispenser according to a preferred embodiment of the present invention.

FIG. 4 shows a bottom perspective view of the shower member.

As shown in the drawing, the shower member 20 further comprises hook projections 33 extending downward from both sides of the detergent shower portion 22.

A front portion of the hook projections 33 are gently inclined frontward and a rear portion of the hook projections 33 are steeply inclined rearward. As a result, the laundry aid container 60 can be smoothly inserted into the receiving cavity 40 under the shower member 20 while smoothly going over the gently inclined front portion of the hook projections 33. However, when a user intends to withdraw the laundry aid container 60 from the receiving cavity 40, since the laundry aid container 60 is hooked on the steeply inclined rear portion of the hook projections 33, it cannot be withdrawn until the user slightly lifts the laundry aid container 60. The laundry aid container 60 has container-removal preventing steps 98 and 99 (see FIG. 5) corresponding to the hook projections 33.

The operation of the shower member will be now described with reference to the water flow path.

Water is supplied to the addition agent shower portion 21 from the nozzle 16, and is then directed to the laundry aid container 60 through the plurality of holes formed on the addition agent shower portion 21.

Water is supplied to the detergent shower portion 22 from the nozzle 17, and is then fed to the laundry aid container 60 through the holes formed on the detergent shower portion 22.

Warm water is fed to the receiving cavity from the nozzle 15 through the warm water drain hole 29, and is then directly supplied to the washtub without going by way of the laundry aid container 60.

That is, when the washing machine is set to a rough washing mode, the warm water is directly fed to the washtub without going by way of the laundry aid container 60. In addition, when it is intended to feed the laundry aid such as the detergent or softener together with the warm water, additional water is fed through the nozzle 16.

In order to stably and quickly supply the warm water to the washtub, the design is such that residual warm water that is not drained through the warm water drain hole 29 is drained through the wave wall 30 and further through the auxiliary warm water drain portion 31.

Furthermore, to prevent the warm water that is not drained even through the auxiliary warm water drain portion from overflowing to the shower portions 21 and 22, the plurality of check grooves 32 are formed above the wave wall 30. That is, the water is maintained in a warm water holding space defined by the check grooves 32 and the inner-rear wall defining the receiving cavity 40. When the warm water completely fills the warm water holding space, by design, the warm water is more quickly drained through the warm water drain hole 29, the wave wall 30, and the auxiliary warm water supply portion 31.

Figure 5:
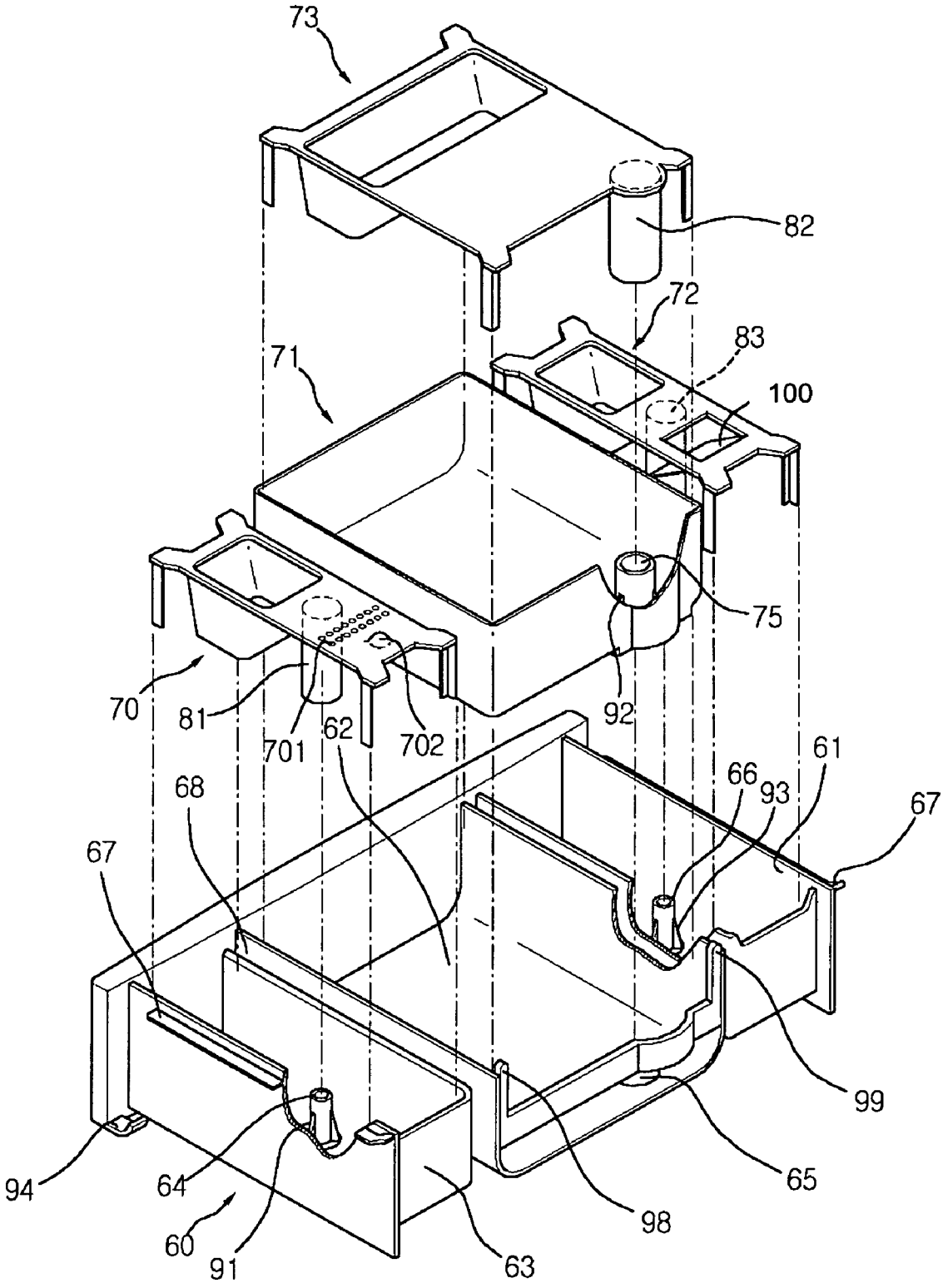
FIG. 5 is a rear perspective view of a laundry aid container of a laundry aid dispenser according to a preferred embodiment of the present invention.

FIG. 5 shows a rear perspective view of the laundry aid container of the inventive washing machine.

As shown in the drawing, the laundry aid container 60 comprises a front handle and a plurality of chambers formed rearward of the front handle. Hook members 94 are formed on lower opposite sides of the handle.

The plurality of chambers comprise a softener chamber 61, a detergent chamber 62, and an addition agent chamber 63, which are disposed adjacent to each other on the rear wall of the handle. The chambers 61, 62, and 63 are respectively covered with a softener siphon member 72, a detergent siphon member 71, and an addition agent siphon member 70. As the softener, fabric softener may be used; and as the addition agent, bleach may be used for the rough washing mode.

The softener chamber 61 and the addition agent chamber 63 have respectively siphon guides 64 and 66 protruded upward. The siphon guides 64 and 66 are respectively provided, at their outer circumferences, with gap-maintaining bosses 91 and 93. Rib guides 67 are formed on upper-outer sidewalls defining the chambers 61 and 63.

The siphon member 70 has legs extending downward from its four corners to maintain a predetermined vertical gap. The siphon member 72 also has legs extending downward from its four corners to maintain a predetermined vertical gap. The siphon members 70 and 71 and outer siphon guides 81 and 83 inserted around the siphon guides 64 and 66, respectively.

Particularly, the softener siphon member 72 is provided at a top thereof with a water supply surface 100 inclined such that all the softener can be fed into the washtub by allowing the water to sufficiently flow into the entire space of the chamber 61. The addition agent siphon member 70 is provided at the top with a projection 702 for reducing noise caused by the water dropping down, and with a plurality of holes 701 formed at the front side of the projection 702.

A lower portion of a rear wall of the detergent chamber 62 is opened so that the detergent dissolved by water fed. into the chamber 62 can be quickly drained. The detergent chamber 62 is provided at its rear bottom with a detergent siphon spout hole 65 and at rear ends of the sidewalls with the above-described container-removal preventing steps 98 and 99.

In addition, the detergent siphon member 71 is covered with a detergent siphon cover 73.

The detergent siphon member 71 is provided at its bottom with a guide 75 extending upward, and the detergent siphon cover 73 is provided with an outer siphon guide 82 that extends downward and is inserted around the guide 75 of the detergent siphon member 71. A gap-maintaining boss 92 is also formed on an outer circumference of the guide 75.

In addition, the hook members 94 formed on a lower end of the handle are hooked on hook grooves 48 (see FIG. 8) formed on a lower end portion of a bottom wall defining the receiving cavity 40, thereby stably maintaining the insertion state of the laundry aid container 60 in the receiving cavity 40.

The siphon members 70 and 72 are respectively disposed on the chambers 61 and 63 by association of the guides 64 and 66 with the guides 81 and 83. At this point, the gaps between the guides 64 and 66 and the guides 81 and 83 can be uniformly maintained by the gap-maintaining bosses 91 and 93, respectively.

The rib guides 67 respectively formed on the outer sidewalls defining the chambers 61 and 63 are disposed contacting ribs formed on opposite sidewalls defining the receiving cavity 40, thereby accurately guiding the insertion operation of the laundry aid container 60 into the receiving cavity 40.

Meanwhile, the inclined water supply surface 100 formed on the top of the siphon member 72 is located just below the cold water supply nozzle 18 (See FIG. 2) so that falling water from the nozzle 19 can reach the front side of the chamber 61 by the falling force, thereby mixing all of the softener in the chamber 61 with the water and improving the washing efficiency.

The projection 702 and holes 701 formed on the top of the siphon member 70 are provided to attenuate the noise that may be caused when a large amount of water falls on the top, particularly when the addition agent shower portion 21 of the shower member 20 is removed.

The detergent siphon spout hole 65 is provided for when the detergent is a liquid agent. That is, the liquid detergent is drained into the washtub by the siphon action of the detergent siphon spout hole 65, and the spout hole 65 is aligned with the siphon guide 75. However, the detergent siphon spout hole 65 is also used for powdered detergent mixed with water. In addition, a portion of a rear wall defining the detergent siphon member 71 is arched rearward, and a portion corresponding to the arched portion of the siphon member 71 of the detergent chamber 62 is also arched so that the user can easily and conveniently locate the detergent siphon member 71 on the detergent chamber 62.

The siphon action will be described more in detail hereinafter.

As water is supplied, the level of water mixed with the laundry aids is gradually heightened along gaps formed between the outer circumferences of the guides 64 and 66 and the inner circumferences of the guides 81 and 83. At this point, once the water mixed with the laundry aids starts draining, the water contained in the chambers 61 and 66 is completely exhausted by the siphon action.

Describing in more detail, as water is supplied to the chambers 61 and 63 such that the water level reaches the top ends of the guides 64 and 66, the water is drained through inner passages of the guides 64 and 66. Once the drain starts, all of the water within the chambers 61 and 63 is completely drained.

This action can be identically applied to the detergent chamber 62. However, since the detergent chamber is generally designed to use a powdered detergent, the detergent siphon member 71 is particularly further employed. That is, when the detergent is a powdered detergent, the detergent siphon member 71 and the detergent siphon cover 73 are not employed, but when the detergent is a liquid detergent, the siphon member and covers 71 and 73 are employed for the siphon action.

Figure 6:
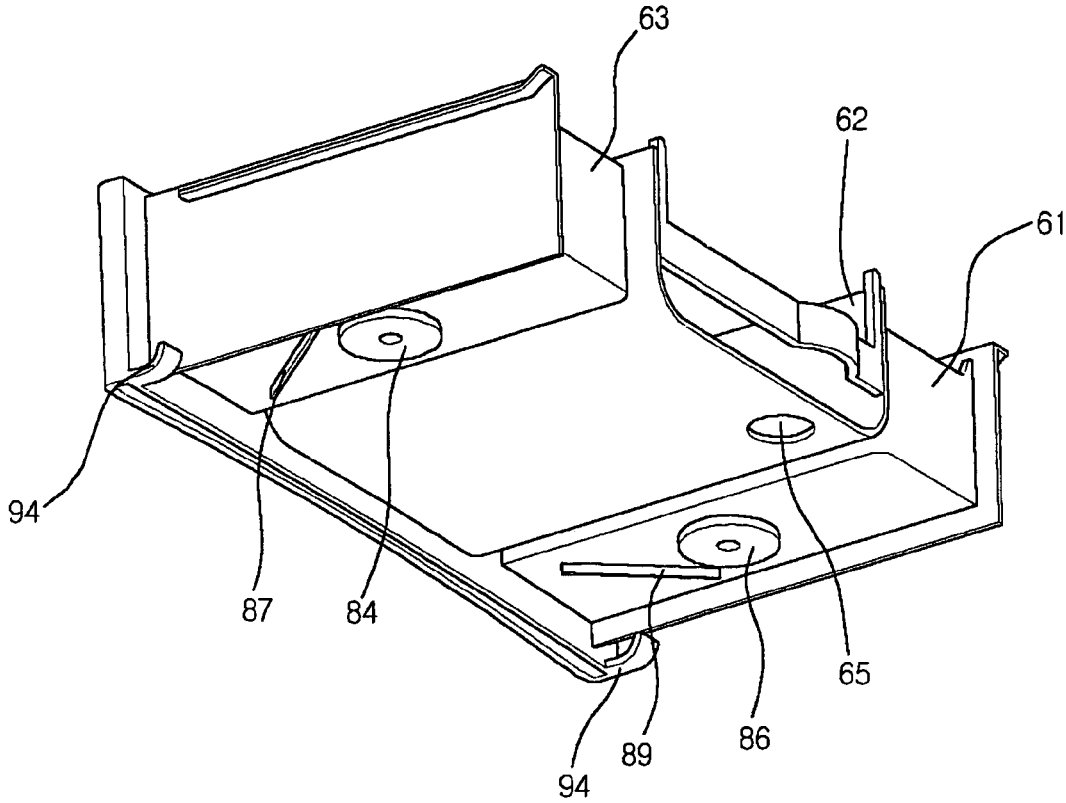
FIG. 6 is a bottom perspective view of a laundry aid container of a laundry aid dispenser according to a preferred embodiment of the present invention.

FIG. 6 shows a bottom perspective view of the laundry aid container of the laundry aid dispenser of the present invention.

In the drawing, there are shown protruded members 84 and 86 extending downward from the bottom of the chambers 61 and 63, respectively, gap maintaining ribs 87 and 89 extending downward from the bottom of the chambers 61 and 63 in the vicinity of the protruded members 84 and 86, respectively, and the above described hook members 94.

Describing more in detail, the protruded members 84 and 86 are provided to maintain heights from inner bottom surfaces (the lowest water inflow level) of the chambers 61 and 63 to the top ends (i.e., the lowest water outflow level) of the guides 64 and 66 to be greater than a predetermined level, thereby completely draining the water by the siphon action. Namely, in order to perform the siphon action, a height between the lowest water inflow level and the lowest water outflow level should be greater than a predetermined level.

When the laundry aid container 60 is formed of a deformable material such as plastic, the lowest water levels may be varied by the deformation of the container 60. This causes the laundry aids to remain in the chambers 61 and 63 even when the washing operation is finished. Therefore, to prevent the deformation of the container 60, the protruded members 84 and 86 are provided on the outer bottom surfaces of the chambers 61 and 63. However, if the chambers 61 and 63 are formed having a sufficient thickness or they are formed of a low deformation material, the protruded members 84 and 86 may not be provided.

The gap maintaining ribs 87 and 89 are provided to further reinforce the container, thereby more reliably performing the siphon action.

Figure 7:
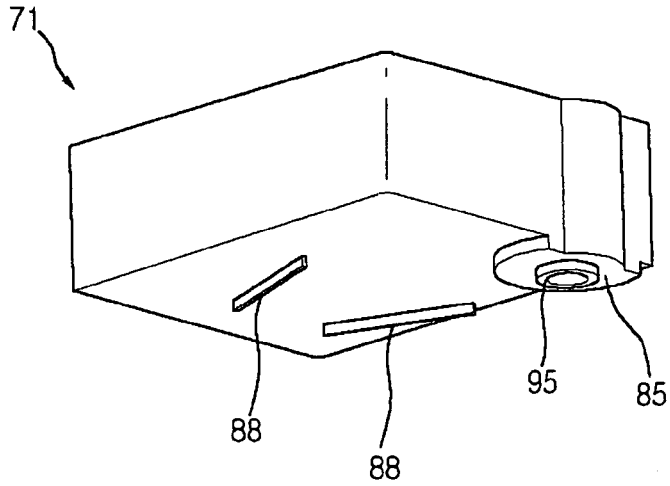
FIG. 7 is a bottom perspective view of a laundry aid siphon member of a laundry aid dispenser according to a preferred embodiment of the present invention.

FIG. 7 is a bottom perspective view of the detergent siphon member.

As shown in the drawing, a protruded member 85 extending downward and corresponding to a portion around the detergent siphon guide 75, an insertion member 95 protruded downward from the protruded member 85 and inserted in the siphon spout hole 65 for efficient siphon action, and a gap maintaining rib 88 for maintaining a gap between the detergent siphon member 71 and the detergent chamber 62 to be greater than a predetermined level are formed on an outer bottom surface of the detergent siphon member 71.

As the function of the protruded member 85 is similar to that of the protruded members 84 and 86 formed on the outer bottom surface of the detergent chambers 61 and 63, a detailed description thereof will be omitted herein.

It has been noted through a series of tests that a difference between the lowest water inflow level and the lowest water outflow level should be maintained to be greater than 3 mm for normal siphon action.

The siphon action may be disturbed at a portion where the inner bottom surface of the detergent chamber 63 contacts the detergent siphon member 71 due to surface tension of the water. However, the insertion of the insertion member 95 into the siphon spout hole 65 prevents such disturbance. That is, the water being drained by the siphon guide 75 by the siphon action is directly fed to the receiving cavity without going by way of where the inner bottom surface of the detergent chamber 63 contacts the detergent siphon member 71.

The function of the gap maintaining ribs 88 is identical to that of the gap maintaining ribs 87 and 89 respectively formed on the outer bottom surfaces of the chambers 61 and 63.

Figure 8:
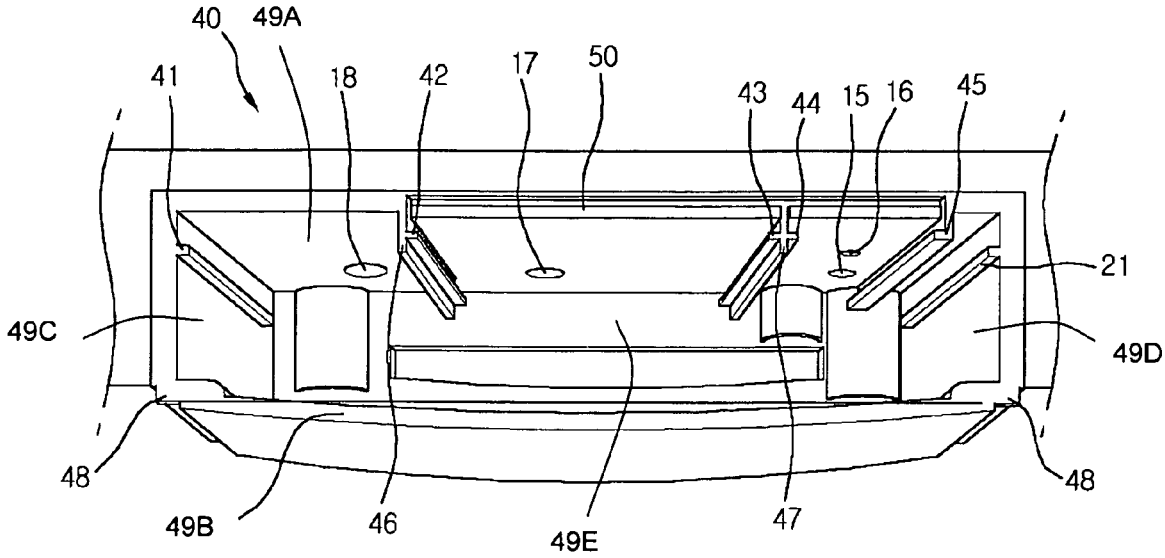
FIG. 8 is a front perspective view illustrating a receiving cavity of a laundry aide dispenser according to a preferred embodiment of the present invention.

FIG. 8 is a front perspective view of the receiving cavity.

The receiving cavity 40 is formed by indenting a portion of the rear inner wall defining the opening of the top cover 10. Therefore, there is no need to prepare a specially manufactured housing shown in the prior art.

Describing more in detail, the receiving cavity 40 is defined by a top wall 49A, a bottom wall 49B, opposing sidewalls 49C and 49D, and an inner wall 49E. The nozzles 15, 16, 17, and 18 are installed on the top wall 49A. Supporting/guiding members 41 for supporting and guiding the laundry aid container 60 are formed on the opposing sidewalls 49C and 49D. First, second, third, and fourth guiding/supporting members 42, 43, 44, and 45 for guiding and supporting the shower member 20 are formed extending downward from the top wall 49A, and are bent horizontally. First and second barriers 46 and 47 for preventing water from overflowing between the chambers are respectively formed extending downward from the first guiding/supporting member 42 and the second and third guiding/supporting members 43 and 44.

Hook grooves 48 are formed on both side ends of an outer surface of the bottom wall 49B to prevent the hook members 94 from being hooked when the laundry aid container 60 is completely inserted in the receiving cavity 40. A shower member fixing member 50 in which the hook 24 of the shower member 20 is securely fitted when the shower member is inserted in the receiving cavity 40 is formed on the front end of the top wall 49A.

The rib guides 67 of the laundry aid container 60 is disposed on the supporting/guiding members 41 so that reciprocating motion of the laundry aid container 60 can be stably realized.

The side ends of the shower member 20 and both ends of the rib guide 23 are slidably hooked on the first, second, third, and fourth guiding/supporting members 42, 43, 44, and 45. Accordingly, the insertion motion of the shower member 2 in the receiving cavity 40 can be stably guided.

The barriers 46 and 47 are disposed between the chambers 61, 62, and 63 to prevent the water fed into the chambers 61, 62, and 63 from overflowing other chambers. That is, the chambers 61, 62, and 63 are separated from each other by rib insertion grooves 68 and 69 (see FIG. 5).

The hook grooves 48 are coupled with the hook members 94 when the laundry aid container 60 is completely inserted into the receiving cavity 40. That is, the coupling of the hook grooves 48 and the hook members 94 makes the user identify the complete insertion of the laundry aid container 60 in the receiving cavity 40. In addition, the coupling of the hook grooves 48 and the hook members 94 prevents the laundry aid container 60 from being inadvertently removed from the receiving cavity 40.

The bottom wall 49B defining the receiving cavity 40 functions as a water flow passage. That is, the bottom wall 49B is inclined frontward and from side ends to a center, thereby realizing an effective water drain and preventing laundry aid dregs from remaining in the receiving cavity 40.

The shower member fixing member 50 is a longitudinal projection inserted into the hook 3 shown in FIG. 3, thereby securely fixing the shower member 20 and preventing the water fed to the shower member 20 from overflowing frontward.

FIGS. 9A to 9D are views illustrating the siphon action of the laundry aid dispenser of the present invention.

Figure 9A:
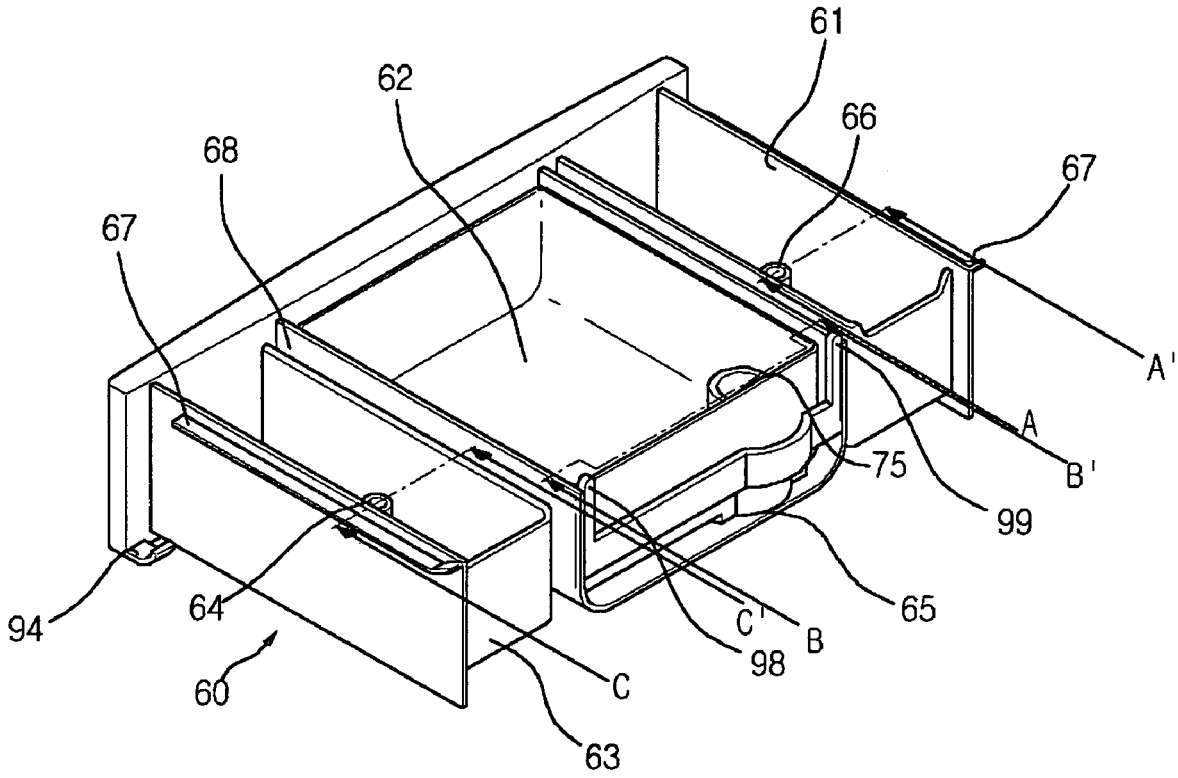
FIG. 9A is a view illustrating a state where a laundry aid siphon member is received in a laundry aid container according to a preferred embodiment of the present invention.
Figure 9B:
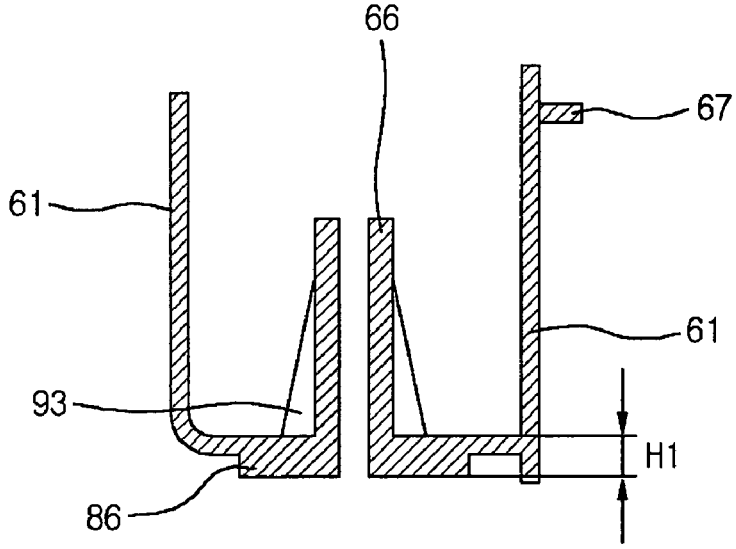
FIG. 9B is a sectional view taken along line A-A' of FIG. 9A.
Figure 9C:
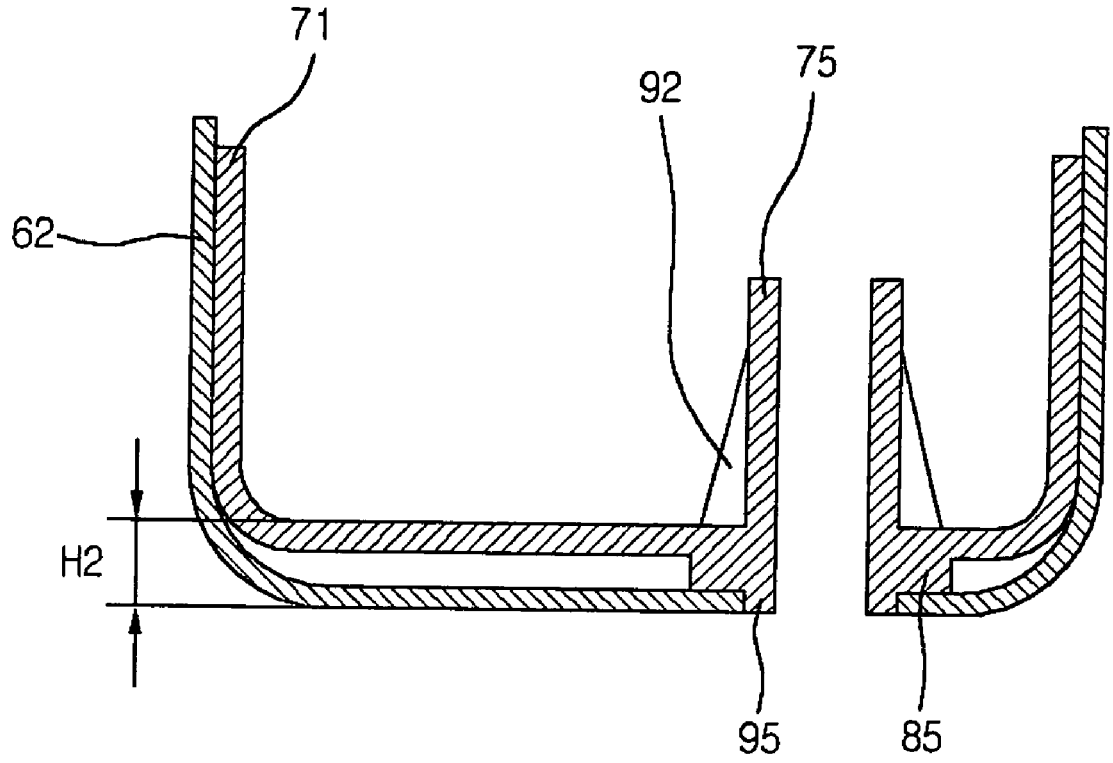
FIG. 9C is a sectional view taken along line B-B' of FIG. 9A.

FIG. 9A shows the laundry aid container receiving the siphon member. FIG. 9B is a sectional view taken along line A-A' of FIG. 9A; FIG. 9C is a sectional view taken along line B-B' of FIG. 9A; and FIG. 9D is a sectional view taken along line C-C' of FIG. 9A.

Figure 9D:
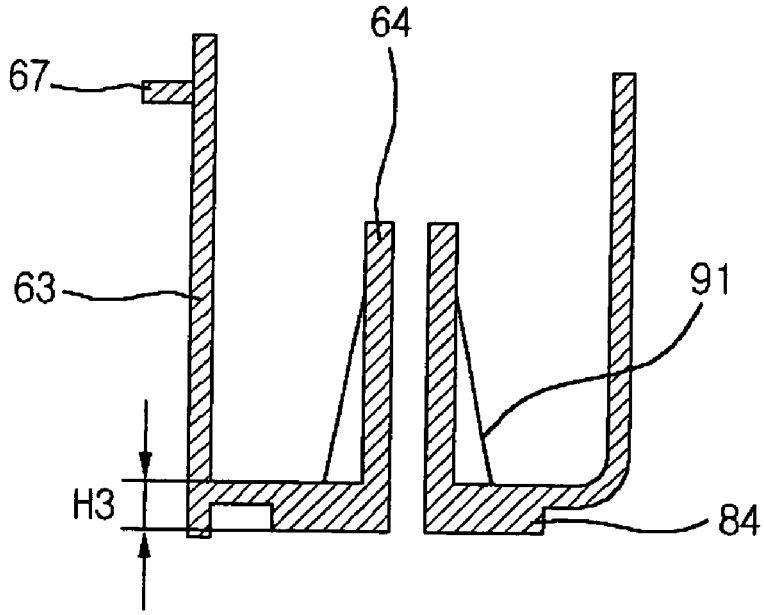
FIG. 9D is a sectional view taken along line C-C' of FIG. 9A.

When a height between the inner bottom surface (the lowest water inflow level) of the softener chamber 61 and the lower end of the protruded member 86 is H1 as shown in FIG. 9B and a height between the inner bottom surface (the lowest water inflow level) of the addition agent chamber 63 and the protruded member 84 is H3 as shown in FIG. 9D, the heights H1 and H3 should be maintained to be higher than a predetermined level.

In FIG. 9C, the reference sign H2 indicates a height between the inner bottom surface (the lowest water inflow level) of the detergent siphon member 71 and the lower end of the protruded member 95.

To maintain the heights H1, H2, and H3 to acceptable levels, the gap maintaining ribs and the protruded members are provided.

Figure 10:
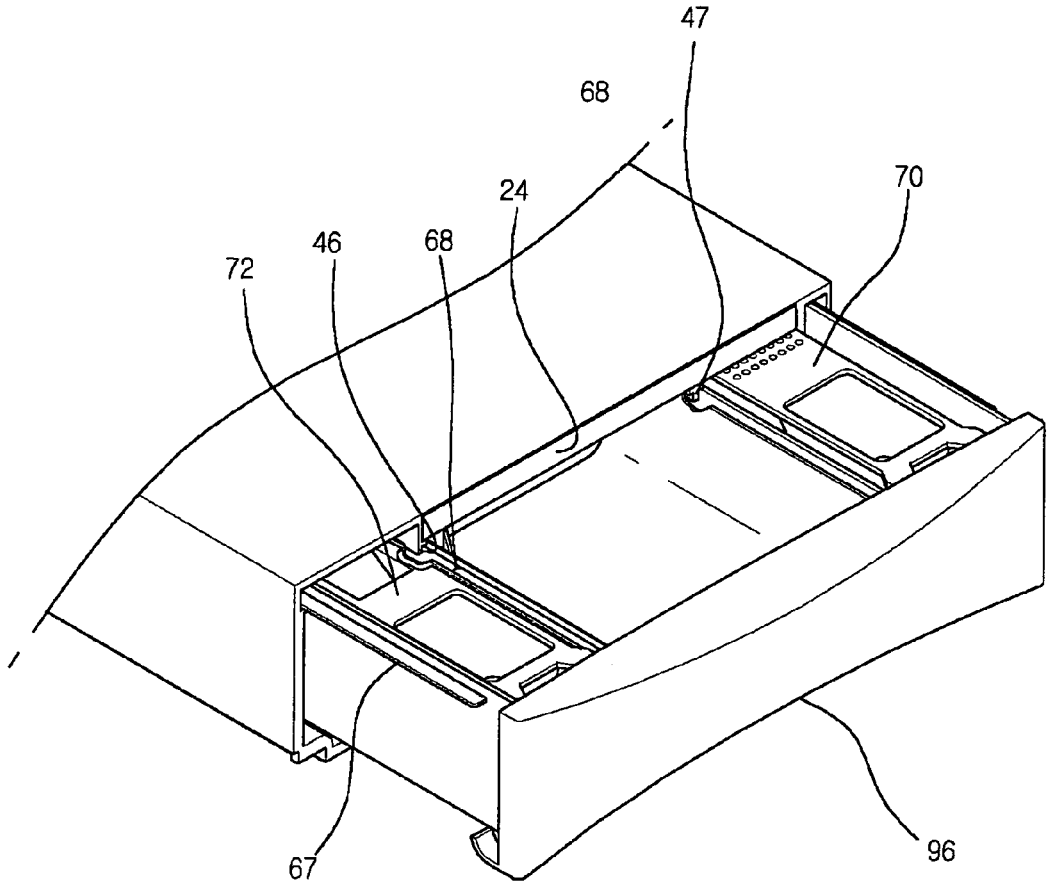
FIG. 10 is a perspective view illustrating an insertion process of a shower member and a laundry aid container into a receiving cavity according to a preferred embodiment of the present invention.

FIG. 10 shows an insertion process of the shower member and the laundry aid container into the receiving cavity.

As shown in the drawing, as the guide ribs 67 are slidably supported on the supporting/guiding members 41, the insertion/withdrawal of the laundry aid container 60 can be smoothly realized.

The hook members 94 are interlocked with the hook grooves 48, preventing the laundry aid container 60 from inadvertently being removed from the receiving cavity 40.

The first and second barriers 46 and 47 are inserted into the rib insertion grooves 68 and 69 to suppress the water movement between the chambers of the laundry aid container 60. The hook 24 formed on the front-top end of the shower member 20 is tightly fitted in the shower member-fixing member 50 (see FIG. 8) to suppress the water leakage through the top of the shower member 20.

The lower end of the front handle of the laundry aid container 60 is curved upward to define a water outflow opening 96 such that the water from the receiving cavity 40 can be drained through the water outflow opening 96.

Figure 11:
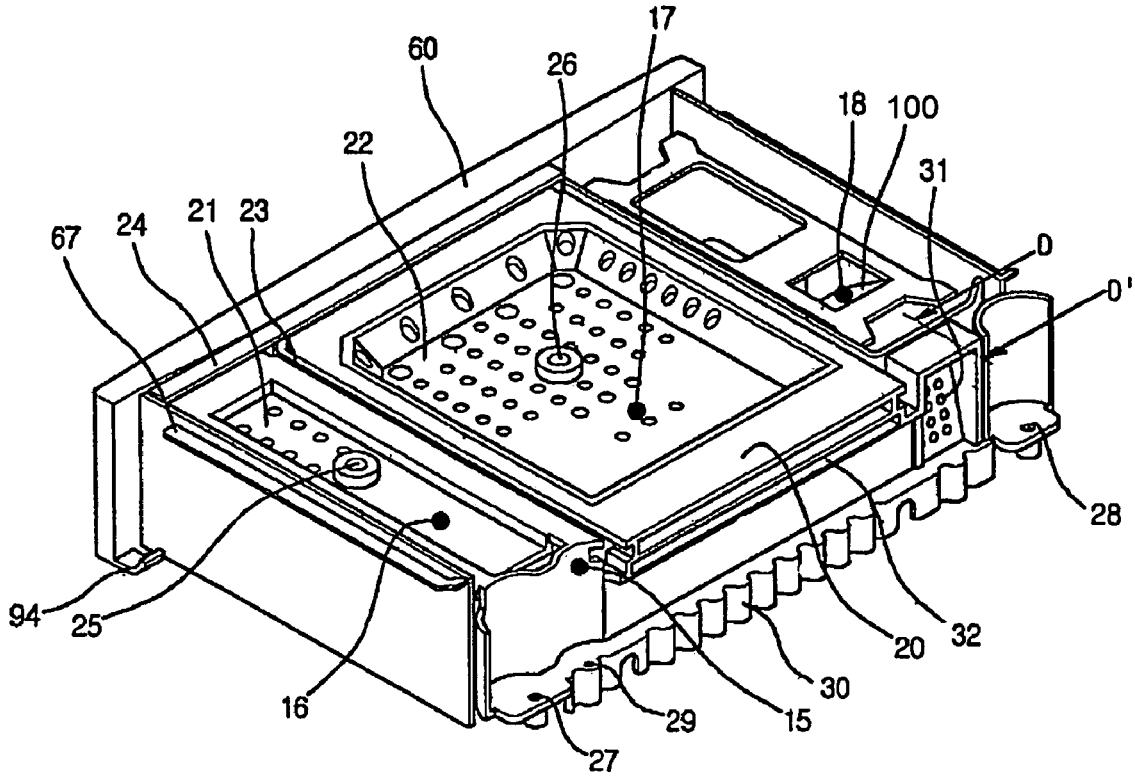
FIG. 11 is a perspective view illustrating an operation of a laundry aid dispenser according to a preferred embodiment of the present invention.

FIG. 11 shows the operation of the laundry aid dispenser in a state where the laundry aid container and the shower member are aligned.

As shown in the drawing, the shower member 20 is disposed on the laundry aid container 60 by aligning the rib insertion groove and the rib guide 23 in a line. At this point, the addition agent shower portion 21 and the detergent shower portion 22 are respectively aligned with the addition agent chamber 63 and the detergent chamber 62.

The rear end of the shower member 20 surface-contacts the rear wall defining the receiving cavity 40 such that a predetermined space, through which warm water flows, can be formed therebetween.

The warm water nozzle 15 is disposed directly above the warm water drain hole 29, the cold water supply nozzle 16 is formed directly above the addition agent shower portion 21 to mix the addition agent with cold water, the cold water supply nozzle 17 is provided directly above the detergent shower portion 22 to mix the detergent with cold water, and the cold water supply nozzle 18 is disposed directly above the water supply surface of the softener shower portion 23 to effectively mix the softener with water.

The cold or warm water fed to the shower member 20 or the laundry aid container. 60 through the water supply nozzles 15, 16, 17, and 18 are drained to the washtub through the receiving cavity 40. That is, the water properly mixed with the laundry aids such as the detergent, softener, or addition agent.

Figure 12:
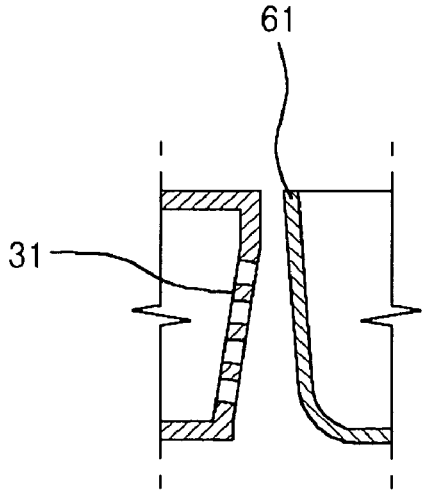
FIG. 12 is a sectional view taken along line D-D' of FIG. 11.

FIG. 12 is a sectional view taken along line D-D' of FIG. 11.

The auxiliary warm water supply portion 31 and the softener chamber 61 are inclined such that a gap between them is gradually increased as it goes upward. This structure enhances the warm water drain through the auxiliary warm water supply portion 31.

Although the preferred embodiments of the present invention have been disclosed for illustrative purpose, those skilled in the art will appreciate that various modifications, additions and substitutions can be made without departing from the scope and spirit of the invention as defined in the accompanying claims.

For example, the laundry aid dispenser of the present invention can be applied to a drum-type washing machine as well as a pulsating or agitator type washing machine.

Furthermore, the arrangement of the laundry aid chambers is not limited to the above-described embodiment, but it can be varied in accordance with a variety of purposes.

INDUSTIRAL APPLICABILITY

The laundry aid dispenser of the present invention has an advantage in that it can variably control the water supply to the laundry aid container. Particularly, since only the warm water without mixing with any of the laundry aids can be fed to the washtub, the operation mode of the washing machine can be further varied according to the user's intension.

In addition, since the receiving cavity is formed by indenting a portion of the top cover, the inner space of the washing machine can be more effectively utilized.

The invention claimed is:

1. A laundry aid dispenser for a washing machine, comprising:

a top cover disposed above a washtub for receiving clothes;

a receiving cavity defined by an upper wall, a bottom wall, opposing sidewalls, and an inner wall that are formed by indenting a portion of the top cover, the receiving cavity having a plurality of cold and warm water supply nozzles;

a shower member comprising a shower portion coupled on the upper wall defining the receiving cavity and a warm water staying space defined by a warm water guide portion comprising a rear wall of the shower portion and the inner wall defining the receiving cavity;

a laundry aid container for storing laundry aids, the laundry aid container being inserted in the receiving cavity under the shower member, the laundry aid container having at least two chambers each for storing a different laundry aid; and a wave wall formed extending downward from the warm water guide portion, the wave wall defining a plurality of passages with the inner wall defining the receiving cavity so that warm water can be drained to the receiving cavity through the plurality of passages.

2. The laundry aid dispenser of claim 1 wherein the laundry aid container comprises:

an addition agent chamber for storing an addition agent;

a detergent chamber for storing detergent, the detergent chamber being disposed adjacent to and spaced away from the addition agent chamber;

and a softener chamber for storing a softener, the softener chamber being disposed adjacent to and spaced away from the detergent chamber.

3. The laundry aid dispenser of claim 1, wherein the laundry aid container further comprises a handle having hook members formed on lower-side ends of the handle and hooked on a hook groove formed on the bottom wall of the receiving cavity when the laundry aid container is completely inserted in the receiving cavity.

4. The laundry aid dispenser of claim 1 further comprising:

longitudinal guide ribs formed on both side walls of the laundry aid container;

and supporting/guiding members formed on the opposing sidewalls defining the receiving cavity, the guide ribs being supportably disposed on the longitudinal guide ribs for insertion/withdrawal of the laundry aid container in/out of the receiving cavity.

5. The laundry aid dispenser of claim 1 further comprising:

chamber barriers formed extending downward from the top wall defining the receiving cavity;

and barrier insertion grooves formed between the chambers, the chamber barriers being inserted into the barrier insertion grooves when the laundry aid container is inserted into the receiving cavity.

6. The laundry aid dispenser of claim 1 further comprising:

at least two container-removal preventing steps formed on the laundry aid container;

and hook projections corresponding to the container-removal preventing steps formed on an outer bottom surface of the shower member, a front portion of each hook projection being gently inclined and a rear portion of each hook projection being steeply inclined.

7. The laundry aid dispenser of claim 1 further comprising a siphon member disposed on the laundry aid container, wherein an inner siphon guide is formed extending from an inner bottom surface of one of the chambers;

and an outer siphon guide is formed extending downward from the siphon member and is inserted around the inner siphon guide.

8. The laundry aid dispenser of claim 7, wherein gap-maintaining bosses are formed on an outer circumference of the inner siphon guide so as to maintain a predetermined gap between the outer circumference of the inner siphon guide and an inner circumference of the outer siphon guide.

9. The laundry aid dispenser of claim 7, wherein a protruded member is formed extending downward from an outer bottom surface of the chamber where the inner siphon guide is formed.

10. The laundry aid dispenser of claim 7, wherein a gap maintaining rib is formed extending downward from an outer bottom surface of the chamber.

11. The laundry aid dispenser of claim 1 further comprising a siphon member disposed on the laundry aid container, the siphon member having a concave portion for preventing noise that may be generated by water dropping down on the siphon member.

12. The laundry aid dispenser of claim 1 further comprising a siphon member disposed on the laundry aid container, the siphon member being having a plurality of passage holes through which water can be evenly supplied to one of the chamber.

13. The laundry aid dispenser of claim 1 further comprising a siphon member disposed on the laundry aid container, the siphon member having a water supply surface inclined to stably supply water to one of the chambers.

14. The laundry aid dispenser of claim 1 further comprising:

a detergent siphon member received in a detergent chamber of the chambers having a spout hole, the detergent siphon member having an inner siphon guide extending upward and aligning with the spout hole;

and a detergent siphon cover disposed on the detergent siphon member, the detergent siphon cover having an outer siphon guide for inserting around the inner siphon guide.

15. The laundry aid dispenser of claim 14, wherein the detergent siphon member comprises a protruded member formed extending downward and corresponding to the inner siphon guide;

and an insertion member formed extending downward from the protruded member, for insertion in a spout hole.

16. The laundry aid dispenser of claim 14, wherein the inner siphon guide comprises a gap-maintaining member for providing a predetermined gap between the outer circumference of the inner siphon guide and an inner circumference of the outer siphon guide.

17. The laundry aid dispenser of claim 14, wherein the detergent siphon member comprises a gap maintaining rib for maintaining a predetermined gap between the detergent siphon member and the detergent chamber.

18. The laundry aid dispenser of claim 14, wherein a predetermined portion of the detergent siphon member is curved, and a predetermined portion of the detergent chamber is also curved corresponding to the curved portion of the detergent siphon member, thereby making it easy to set up a disposing location of the detergent siphon member.

19. The laundry aid dispenser of claim 1 wherein inner bottom surfaces of the chambers are sloped frontward.

20. The laundry aid dispenser of claim 1 further comprising:

a hook member formed on a front end of the shower member;

and a fixing member formed on one of the walls defining the receiving cavity, the fixing member being associate with the hook when the shower member is completely inserted in the receiving cavity.

21. The laundry aid dispenser of claim 1, wherein the shower portion comprises an indented bottom portion and a plurality of passage holes formed on the indented bottom portion.

22. The laundry aid dispenser of claim 1 further comprising supporting/guiding members for supporting and guiding an insertion/withdrawal of the shower member into/from the receiving cavity, the supporting/guiding members being formed extending downward from the top wall and being bent horizontally.

23. The laundry aid dispenser of claim 1 further comprising:

at least two supporting/guiding members formed extending from the top wall defining the receiving cavity and bent horizontally;

and a rib guide for guiding an insertion/withdrawal of the shower member by at lease one of the supporting/guiding members, which contacts an outer bottom surface of the shower portion.

24. The laundry aid dispenser of claim 1, wherein the warm water guide portion comprises a warm water drain hole through which warm water fed from a warm water nozzle is drained to the receiving cavity.

25. The laundry aid dispenser of claim 24, wherein the warm water drain hole is formed at a one-sided portion.

26. The laundry aid dispenser of claim 1 further comprising an auxiliary warm water-supplying portion formed on a portion of the warm water guide portion, the auxiliary warm water-supplying portion having a plurality of holes.

27. The laundry aid dispenser of claim 1 further comprising a check grooves formed on an upper portion of the warm water guide portion to prevent warm water in the warm water staying space defined by the warm water guide portion and the inner wall defining the receiving cavity from overflowing.

28. The laundry aid dispenser of claim 1, wherein the shower portion has a screw-fixing hole in which a screw passing through the top cover is inserted.

29. The laundry aid dispenser of claim 1, wherein the warm water guide portion has a screw-fixing hole in which a screw passing through the top cover is inserted.

30. The laundry aid dispenser of claim 1, wherein the bottom wall defining the receiving cavity is inclined frontward so that water can be effectively fed to the washtub.

31. The laundry aid dispenser of claim 1, wherein the chambers comprise a detergent chamber, an addition agent chamber and a softener chamber;

and the shower portion comprises a detergent shower portion for the detergent chamber and an addition agent shower portion for the addition agent chamber.

32. A method for mounting a laundry aid dispenser on a washing machine, comprising the steps of:

inserting a shower member in a receiving cavity defined by indenting a portion of a top cover of the washing machine, the shower member comprising a shower portion coupled on an upper wall defining the receiving cavity and a warm water staying space defined by a warm water guide portion comprising a rear wall of the shower portion and an inner wall defining the receiving cavity;

securely fixing the shower member by a screw coupling to a top wall of the receiving cavity defined by the indented portion of the top cover of the washing machine;

inserting a laundry aid container in the receiving cavity; and forming a wave wall extending downward from the warm water guide portion, the wave wall defining a plurality of passages with the inner wall defining the receiving cavity so that warm water can be drained to the receiving cavity through the plurality of passages.

33. The method of claim 32, wherein the shower member firstly fixed in the receiving chamber by a hook structure, the hook structure comprises:

a hook member formed on a front end of the shower member;

and a fixing member formed on a portion defining the receiving cavity and associated with the hook member when the shower member is inserted into the receiving cavity.

34. The method of claim 32, wherein the laundry aid container is fixed in the receiving cavity by a hook structure, the hook structure comprising:

a hook member formed on a front-lower end of the laundry aid container;

and a hook groove formed on a portion defining the receiving cavity and associated with the hook member.

35. The method of claim 32, wherein an insertion/withdrawal of the shower member is guided by a supporting/guiding member formed on a top wall defining the receiving cavity.

36. The method of claim 32, wherein the laundry aid container comprises:

supporting/guiding members formed on opposing sidewalls defining the receiving cavity;

and rib guides formed on opposing sidewalls of the laundry aid container and supported on the supporting/guiding members for an insertion/withdrawal guide into/from the receiving cavity.

* * * * *